US009175610B2

(12) United States Patent
Takagi et al.

(10) Patent No.: US 9,175,610 B2
(45) Date of Patent: Nov. 3, 2015

(54) VEHICLE DRIVING FORCE CONTROL DEVICE

(75) Inventors: Masashi Takagi, Nagoya (JP); Motonari Ohbayashi, Nisshin (JP); Yuki Minase, Toyota (JP); Shinya Kodama, Toyota (JP); Toshihiro Takagi, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/129,189

(22) PCT Filed: Jul. 1, 2011

(86) PCT No.: PCT/JP2011/065161

§ 371 (c)(1),
(2), (4) Date: Dec. 24, 2013

(87) PCT Pub. No.: WO2013/005275

PCT Pub. Date: Jan. 10, 2013

(65) Prior Publication Data

US 2014/0297153 A1 Oct. 2, 2014

(51) Int. Cl.
*F02D 11/06* (2006.01)
*F02D 11/10* (2006.01)

(52) U.S. Cl.
CPC ..... *F02D 11/106* (2013.01); *F02D 11/107* (2013.01); *F02D 2200/602* (2013.01); *F02D 2200/702* (2013.01)

(58) Field of Classification Search
CPC ... F02D 11/06; F02D 11/07; F02D 2200/602; F02D 2200/702
USPC ..... 701/99
See application file for complete search history.

(56) References Cited

U.S. PATENT DOCUMENTS

| | | | | |
|---|---|---|---|---|
| 2009/0062068 | A1* | 3/2009 | Nakai et al. | 477/92 |
| 2012/0271526 | A1 | 10/2012 | Oishi et al. | |
| 2012/0290188 | A1* | 11/2012 | Oishi et al. | 701/99 |
| 2014/0039774 | A1* | 2/2014 | Kodama et al. | 701/99 |

FOREIGN PATENT DOCUMENTS

| | | | |
|---|---|---|---|
| JP | 61-190135 | A | 8/1986 |
| JP | 64-25435 | U | 2/1989 |
| JP | 3-258932 | A | 11/1991 |
| JP | 2000-27674 | A | 1/2000 |
| JP | 2005-207260 | A | 8/2005 |
| JP | 2007-132316 | A | 5/2007 |
| WO | 2011/074035 | A1 | 6/2011 |
| WO | 2013/005275 | A1 | 1/2013 |

OTHER PUBLICATIONS

International Search Report for PCT/JP2011/065161, dated Jul. 26, 2011.

* cited by examiner

*Primary Examiner* — Helal A Algahaim
*Assistant Examiner* — Yazan A Soofi
(74) *Attorney, Agent, or Firm* — Sughrue Mion, PLLC

(57) ABSTRACT

An electronic control unit adjusts drive force generated by an engine in accordance with the amount of manipulation of an accelerator pedal. When the manipulation amount of the accelerator pedal meets a predetermined condition, the electronic control unit executes drive force limiting control for limiting the drive force generated by the engine and changes the degree of limiting of the drive force during the execution of the drive force limiting process according the gradient of the road surface.

4 Claims, 2 Drawing Sheets

VEHICLE DRIVING FORCE CONTROL DEVICE

CROSS REFERENCE TO RELATED APPLICATIONS

This application is a National Stage of International Application No. PCT/JP2011/065161filed Jul. 1, 2011, the contents of all of which are incorporated herein by reference in their entirety.

TECHNICAL FIELD

The present invention relates to a vehicle driving force control device.

BACKGROUND ART

Conventionally, a type of drive force control device for a vehicle has been known that executes a drive force limiting process, for example, as disclosed in Patent Document 1. Specifically, when an accelerator pedal is depressed strongly, the control device limits the drive force generated by the engine to a value lower than the value that corresponds to the manipulation amount of the accelerator pedal.

PRIOR ART DOCUMENT

Patent Document

Patent Document 1: Japanese Laid-Open Patent Publication No. 61-190135

SUMMARY OF THE INVENTION

Problems that the Invention is to Solve

If the drive force limiting process is executed when the vehicle is on a slope, the vehicle might go down the slope due to shortage of the drive force. Such descent of the vehicle can be prevented by executing another control process concurrently, for example, an on-slope brake control process. However, since such additional control process needs to be executed in addition to the drive force control, the overall control will be complicated.

Accordingly, it is an objective of the present invention to prevent descent of a vehicle on slopes with a simple structure.

Means for Solving the Problems

To achieve the foregoing objective and in accordance with one aspect of the present invention, a drive force control device for a vehicle is provided that executes a drive force limiting process, in which the control device limits drive force generated by a drive source to a value lower than a value that corresponds to an manipulation amount of an accelerator. During execution of the drive force limiting process, the device changes the degree of limiting of drive force in accordance with the gradient of a road surface.

According to this configuration, the degree of limiting of drive force is changed in accordance with the gradient of the road surface during execution of the drive force limiting process. Accordingly, the drive force is optimized for the gradient on the slope. Therefore, it is possible to prevent the vehicle from descending due to lack of drive force. Since the configuration prevents descent of the vehicle on the slope by controlling the drive force, it is possible to prevent the vehicle from descending on the slope with a simple configuration.

The degree of limiting of drive force during the execution of the drive force limiting process is preferably reduced as the gradient of the road surface increases.

In accordance with another aspect of the present invention, the drive force limiting process is executed when the accelerator manipulation amount meets a predetermined condition and the vehicle acceleration is greater than or equal to a predetermined determination value. In this case, even if the accelerator manipulation amount meets the predetermined condition, the drive force limiting process is not executed if the acceleration of the vehicle is less than the predetermined determination value. This allows the driver to adjust the vehicle acceleration to some degree, which improves drivability. A state in which the accelerator manipulation amount meeting the predetermined condition includes a case in which, for example, the accelerator manipulation amount exceeds a predetermined value, a case in which the accelerator manipulation amount per unit time exceeds a predetermined value, that is, the rate of change of the accelerator manipulation amount exceeds a predetermined value, and a case in which the rate of change of the accelerator manipulation amount per unit time exceeds a predetermined value, that is, the acceleration of change of the accelerator manipulation amount exceeds a predetermined value.

In accordance with another aspect of the present invention, during the execution of the drive force limiting process, the drive force is limited such that the higher the vehicle speed, the lower the acceleration of the vehicle becomes. In this case, during increase of the vehicle speed through accelerator manipulation, the rate of increase of the vehicle speed is reduced as the vehicle speed is increased. Therefore, it is possible to limit increase of the vehicle speed when the accelerator manipulation amount meets the predetermined condition.

In accordance with another aspect of the present invention, the device determines a feedback drive force through feedback control based on the difference between a target acceleration of the vehicle, which is determined based on the vehicle speed, and the actual acceleration of the vehicle. The device determines a feed-forward drive force through feed-forward control based on the gradient. The device calculates a target drive force during the execution of the drive force limiting control based on the feedback drive force and the feed-forward drive force. In this case, the drive force for compensating for descent of the vehicle due to the gradient is determined through the feed-forward control. Therefore, unlike a case in which the drive force corresponding to the gradient is determined through feedback control, it is possible to suppress the hunting of a target drive force that is calculated during execution of the drive force limiting process.

In accordance with another aspect of the present invention, the device includes an acceleration sensor for detecting acceleration of the vehicle and a speed sensor for detecting speed of the vehicle. The device can use, as a substitute for the gradient, a value obtained by subtracting a differential value of the vehicle speed from a detection value of the acceleration sensor.

MODES FOR CARRYING OUT THE INVENTION

A drive force control device for a vehicle according to one embodiment of the present invention will now be described in detail with reference to FIGS. 1 to 4. The drive force control device of the present embodiment is applied to a vehicle that is configured to generate drive force by output of an engine 6, which is a drive source.

Figure 1:
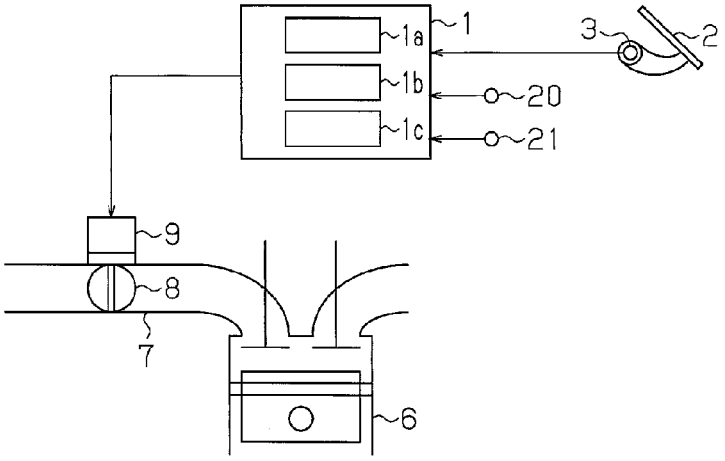
FIG. 1 is a diagram showing the entire structure of one embodiment of the present invention.

As shown in FIG. 1, the drive force control device for a vehicle according to the present embodiment is constructed with an electronic control unit 1 mounted on the vehicle as a dominant constituent. The electronic control unit 1, which functions as a control section, includes a central processing unit (CPU) 1*a*, which runs various computational processes for controlling the vehicle, a read only memory (ROM) 1*b*, which stores programs and data used in control, and a random access memory (RAM) 1*c*, which temporarily stores computation results of the CPU 1*a* and detection results of sensors.

The electronic control unit 1 is connected to various sensors and switches provided at various parts of the vehicle, which include an accelerator pedal sensor 3, a vehicle speed sensor 20, and an acceleration sensor 21. The accelerator pedal sensor 3 detects an accelerator manipulation amount ACCP, which is the depression amount of an accelerator pedal (accelerator manipulation member) 2. The vehicle speed sensor 20 detects the speed of the vehicle (vehicle speed V). The acceleration sensor 21 detects the acceleration of the vehicle. Hereinafter, the acceleration detected by the acceleration sensor 21 will be referred to as a sensor acceleration SA.

The electronic control unit 1 is also connected to actuators provided at various parts of the vehicle, which include a throttle motor 9 for actuating a throttle valve 8. The throttle valve 8 is located in an intake passage 7 of the engine 6 and used for adjusting the engine output.

The electronic control unit 1 acquires the driving state of the vehicle based on detection results of the sensors and switches. The electronic control unit 1 controls the vehicle by outputting command signals to various actuators in accordance with the acquired driving state of the vehicle. For example, the electronic control unit 1 controls the opening degree of the throttle valve 8 in accordance with the accelerator manipulation amount ACCP, thereby adjusting the drive force generated by the engine 6.

As part of the drive force control of the vehicle, the electronic control unit 1 executes a drive force limiting process to prevent excessive acceleration of the vehicle. Specifically, when determining that the accelerator manipulation amount ACCP meets a predetermined condition and the accelerator pedal 2 is depressed strongly, the electronic control unit 1 limits the drive force generated by the engine 6 to a value lower than the value that corresponds to the accelerator manipulation amount ACCP.

If the drive force limiting process is executed when the vehicle is on a slope, the vehicle might go down the slope due to shortage of the drive force. Such descent of the vehicle can be prevented by executing other control process concurrently, for example, an on-slope brake control process. However, since such additional control process needs to be executed in addition to the drive force control, the overall control will be complicated.

In this regard, the drive force limiting process is executed by taking into consideration the gradient of a slope in the present embodiment, so that the control is simplified.

Figure 2:
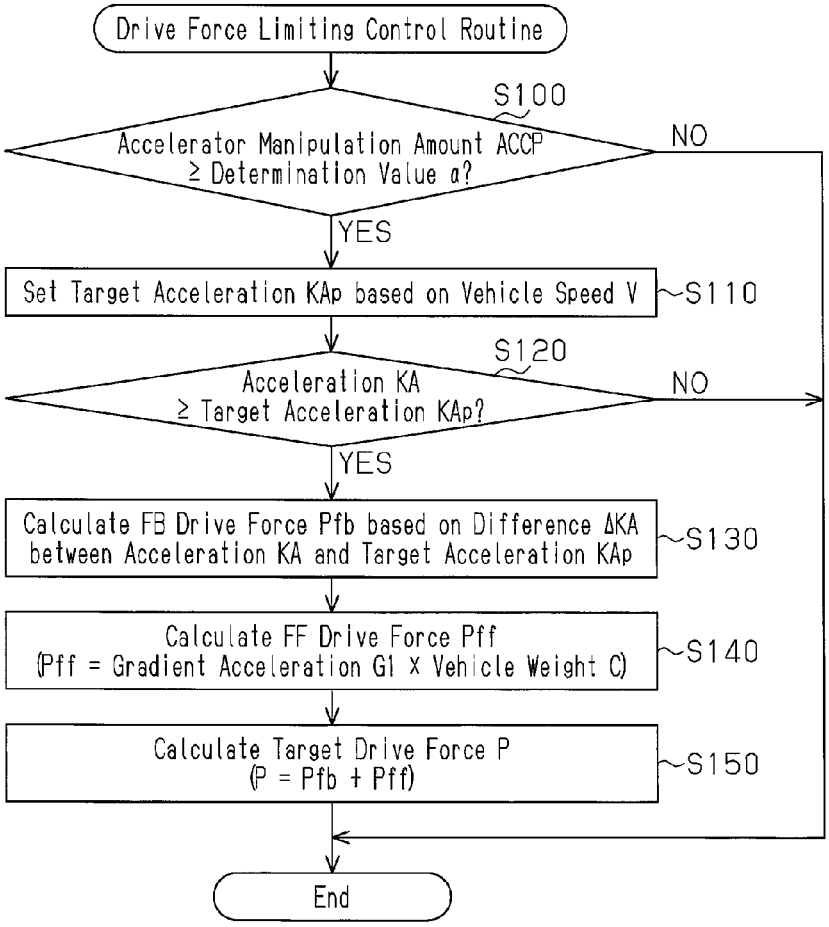
FIG. 2 is a flowchart showing a procedure of a drive force limiting control routine according to the embodiment.

FIG. 2 shows a procedure of the drive force limiting control executed in the present embodiment. The routine is repeated by the electronic control unit 1 at predetermined time intervals.

When this routine is started, it is determined whether the accelerator manipulation amount ACCP is greater than or equal to a determination value α (S100). If the accelerator manipulation amount ACCP is less than the determination value α (S100: NO), the current routine is temporarily suspended.

On the other hand, if the accelerator manipulation amount ACCP is greater than or equal to the determination value α (S100: YES), it is determined that the accelerator pedal 2 is depressed strongly, and step S110 and subsequent steps will be executed continuously.

Figure 3:
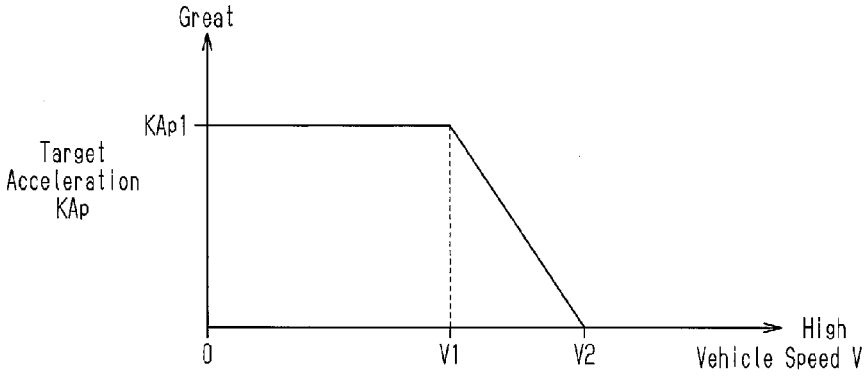
FIG. 3 is a graph showing the relationship between a target acceleration and a vehicle speed.

At step S110, a target acceleration KAp of the vehicle is set based on the vehicle speed V. As shown in FIG. 3, the target acceleration KAp is set to a predetermined fixed value KAp1 when the vehicle speed V is less than a first vehicle speed V1. When the vehicle speed V is greater than or equal to the first vehicle speed V1 and less than a second vehicle speed V2, which is higher than the first vehicle speed V1, the target acceleration KAp is gradually decreased from the fixed value KAp1 as the vehicle speed V increases. Further, when the vehicle speed V is greater than or equal to the second vehicle speed V2, the target acceleration KAp is set to zero. Therefore, when the vehicle speed V exceeds the first vehicle speed V1, the increase of the vehicle speed V becomes gradual, and when the vehicle speed V reaches the second vehicle speed V2, the vehicle speed V is maintained at the second vehicle speed V2.

Next, it is determined whether the actual acceleration KA of the vehicle is greater than or equal to the target acceleration KAp (S120). The acceleration KA is obtained from a differential value of the vehicle speed V.

If the acceleration KA is less than the target acceleration KAp (S120: NO), the current routine is temporarily suspended.

On the other hand, when the acceleration KA is greater than or equal to the target acceleration KAp (S120: YES), the drive force limiting process of step S130 and subsequent steps is executed to actually limit the drive force.

First, at step S130, based on the difference ΔKA (KA−KAp) between the acceleration KA and the target acceleration KAp, a feedback drive force (FB drive force) Pfb, which is a feedback control value, is calculated. That is, the FB drive force Pfb is calculated through feedback control based on the difference ΔKA and is varied in accordance with the difference ΔKA.

Next, based on a gradient acceleration G1 and the vehicle weight C, a feed-forward drive force (FF drive force) Pff, which is a feed-forward control value, is calculated (S140). In the present embodiment, a value obtained by multiplying the gradient acceleration G1 by the vehicle weight C is used as the FF drive force Pff. The vehicle weight C is a value that is determined in advance according to the type of the vehicle. The gradient acceleration G1 is a substitute value that indicates the gradient of the slope.

Figure 4:
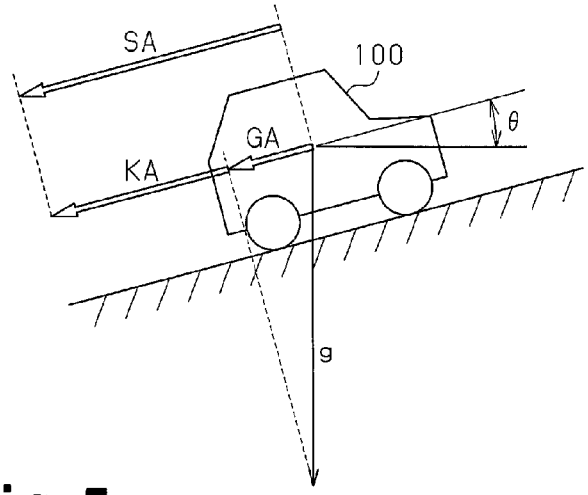
FIG. 4 is a diagram showing the relationship between accelerations of a vehicle and a gradient.

As shown in FIG. 4, when a vehicle 100 is on a gradient of an angle θ, the sensor acceleration SA detected by the acceleration sensor 21 is the sum of the gradient acceleration GA, which is a component of the acceleration of gravity g (9.8 m/s^2), and the acceleration KA of the vehicle. The gradient acceleration GA is obtained by the expression g×sinθ, and is increased as the gradient increases. Therefore, the gradient acceleration GA can be used as a substitute value that indicates the gradient of the slope. The sensor acceleration SA is value that is actually measured by the acceleration sensor 21, and the acceleration KA is a value obtained through differentiation of the vehicle speed V as described above. In the present embodiment, the gradient acceleration GA is calculated by subtracting the acceleration KA from the sensor acceleration SA.

The above described FF drive force Pff is calculated through feed-forward control based on the gradient acceleration GA, such that the greater the gradient acceleration GA, the greater the FF drive force Pff becomes.

At step S150, the FF drive force Pff is added to the FB drive force Pfb to calculate a target drive force P. The current routine is then temporarily suspended. After the target drive force P is calculated, the output of the engine 6 is controlled such that the target drive force P is obtained.

The present embodiment as described above has the following advantages.

(1) When the accelerator manipulation amount ACCP is greater than or equal to the determination value α and the vehicle acceleration KA is greater than or equal to the target acceleration KAp, the drive force limiting process is executed to limit the drive force generated by the engine 6. During execution of the drive force limiting process, the degree of limiting of drive force is changed in accordance with the gradient of the road surface.

More specifically, the FB drive force Pfb is determined through the feedback control based on the difference ΔKA between the target the acceleration KAp of the vehicle determined based on the vehicle speed V and the actual acceleration KA of the vehicle. The FF drive force Pff is adjusted through the feed-forward control such that the greater the greater the gradient of the slope and the greater the gradient acceleration GA, the greater the FF drive force Pff becomes. The sum of the FB drive force Pfb and the FF drive force Pff is calculated as the target drive force P during the execution of the drive force limiting process. Therefore, the greater the gradient of the road surface, the greater the FF drive force Pff becomes. Accordingly, the target drive force P is increased. That is, the degree of limiting of drive force during the execution of the drive force limiting process is reduced as the gradient of the road surface increases.

As described above, the FF drive force Pff, which is a factor of the target drive force P, is changed in accordance with the gradient acceleration GA. Accordingly, during the execution of the drive force limiting process, the degree of limiting of drive force is changed according to the gradient of the road surface. Accordingly, the drive force is optimized in accordance with the gradient on the slope. Therefore, it is possible to prevent the vehicle from descending due to lack of drive force. Since the configuration of the present embodiment prevents descent of the vehicle on a slope by controlling the drive force, it is possible to prevent the vehicle from descending on a slope with a simple configuration without executing other control processes, such as a brake control process, in addition.

(2) The drive force (the FF drive force Pff) required for compensating for the descent of the vehicle due to the gradient is determined through the feed-forward control. Therefore, unlike to a case in which the drive force corresponding to the gradient is determined through feedback control, it is possible to suppress the hunting of the target drive force P, which is calculated during execution of the drive force limiting process.

(3) Step S130 and subsequent steps, which correspond to the drive force limiting process, are executed when the accelerator manipulation amount ACCP is greater than or equal to the determination value α (S100: YES) and the vehicle acceleration KA is greater than or equal to the target the acceleration KAp (S120: YES). Thus, even if the accelerator manipulation amount ACCP is greater than or equal to the determination value α and the accelerator pedal 2 is depressed strongly, the drive force limiting process is not executed unless the vehicle acceleration KA reaches the target the acceleration KAp, so that an acceleration in response to the accelerator manipulation amount ACCP by the driver is obtained. This allows the driver to adjust the vehicle acceleration to some degree, which improves the drivability.

(4) During the execution of the drive force limiting process, if the vehicle speed V exceeds the first vehicle speed V1, the target the acceleration KAp is gradually deceased. Therefore, the drive force is limited such that the higher the vehicle speed V, the lower the vehicle acceleration KA becomes. Thus, during increase of the vehicle speed through accelerator manipulation, the rate of increase of the vehicle speed is reduced as the vehicle speed is increased. This prevents the vehicle speed V from being increased when the accelerator manipulation amount ACCP is greater than or equal to the determination value α.

The above illustrated embodiment may be modified to the forms described below.

To determine whether to execute the drive force limiting process, it is determined whether the accelerator pedal 2 is depressed strongly. At the determination, the accelerator manipulation amount ACCP is compared with the determination value α. However, whether the accelerator manipulation amount meets a predetermined condition may be determined in a different manner. For example, it may be determined whether the accelerator manipulation amount per unit time exceeds a predetermined value, that is, whether the rate of change of the accelerator manipulation amount exceeds a predetermined value. Alternatively, it may be determined whether the rate of change of the accelerator manipulation amount per unit time exceeds a predetermined value, that is, whether the acceleration of change of the accelerator manipulation amount exceeds a predetermined value.

Step S120 of FIG. 2, which is described above, may be omitted. Even in this case, the above described advantages (1), (2) and (4) are achieved.

Figure 5:
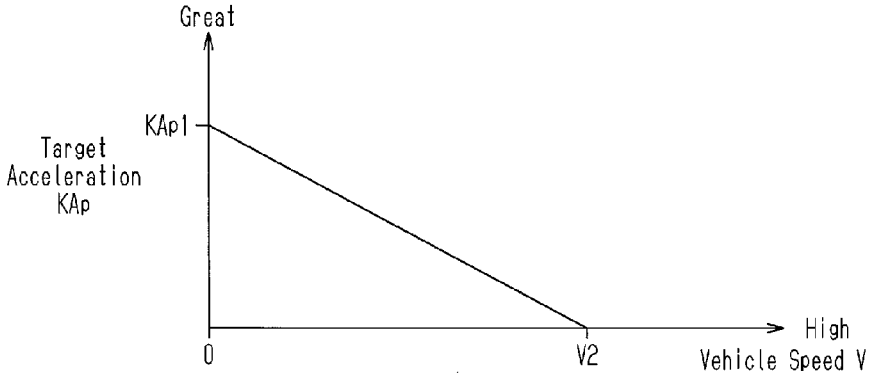
FIG. 5 is a graph showing the relationship between a target acceleration and a vehicle speed according to a modification of the embodiment.

When setting the target the acceleration KAp, the target acceleration KAp is set to the fixed value KAp1 when the vehicle speed V is in the range from zero to less than the first vehicle speed V1 as shown in FIG. 3. Other than this, as shown in FIG. 5, the target acceleration KAp may be varied such that it is gradually reduced as the vehicle speed V increases in the range from zero to less than the second vehicle speed V2. In this case also, the advantage (4) described above is achieved.

During the execution of the drive force limiting process, the FF drive force Pff is calculated based on the gradient acceleration GA so that the degree of limiting of drive force is changed in accordance with the gradient of the road surface. Shortage of the drive force due to the gradient is compensated for by the feed-forward control in the illustrated embodiment. However, the degree of limiting of drive force may be changed according to the gradient of the road surface in a different manner. For example, instead of calculating the FF drive force Pff, the target the acceleration KAp may be adjusted according to the gradient. This modification can be realized by using a correction factor that is increased as the gradient acceleration GA increases and reflecting the correction factor on the target the acceleration KAp.

To change the degree of limiting of drive force during execution of the drive force limiting process according to the gradient of the road surface, shortage of the drive force due to the gradient is compensated for by the feed-forward control in the illustrated embodiment. The degree of limiting of drive force may be changed according to the gradient of the road surface in a different manner. For example, instead of calculating the FF drive force Pff, a feedback gain used in the feedback control for calculating the FB drive force Pfb may be adjusted according to the gradient. In this case, the feedback gain is preferably varied such that the greater the gradient, the greater the feedback gain becomes. Even in this modification, the above described advantages (1), (3) and (4) are achieved.

The gradient acceleration GA, which is calculated by subtracting the vehicle the acceleration KA (KA=a differential value of the vehicle speed V) from the sensor acceleration SA is used as a substitute for the gradient of a slope in the illustrated embodiment. However, the gradient of a slope may be detected in different manners. For example, a sensor for detecting the gradient may be provided independently. Alternatively, the gradient of the current position may be determined based on the map information provided by a navigation system mounted on the vehicle.

In the above embodiment, the accelerator is manipulated through depression of the accelerator pedal 2. However, accelerator manipulation may be performed through manipulation of a member other than a pedal. Accelerator manipulation may be performed, for example, by a manually operated paddle shift or through voice operation.

In the above embodiment, the drive force control device according to the present invention is used in a vehicle having the engine 6 as a drive source. However, the present invention may be used in an electric automobile having an electric motor as a drive source or in a hybrid automobile having an electric motor and an engine as drive sources.

DESCRIPTION OF THE REFERENCE NUMERALS

1 . . . Electronic Control Unit (1*a*. . . Central Processing Unit (CPU), 1*b*. . . Read Only Memory (ROM), 1*c*. . . Random Access Memory (RAM)), 2 . . . Accelerator Pedal, 3 . . . Accelerator Pedal Sensor, 6 . . . Engine (Drive Source), 7 . . . Intake Passage, 8 . . . Throttle Valve, 9 . . . Throttle Motor, 20 . . . Vehicle Speed Sensor, 21 . . . Acceleration Sensor, 100 . . . Vehicle

The invention claimed is:

1. A drive force control device for a vehicle having a drive source, the drive force control device comprising:

an accelerator;

an accelerator manipulation amount sensor configured to detect a manipulation amount of the accelerator; and an electronic control unit, wherein the electronic control unit is configured to:

adjust a drive force generated by the drive source in accordance with the accelerator manipulation amount, set a target acceleration of the vehicle based on a vehicle speed, when one of the accelerator manipulation amount, a rate of change of the accelerator manipulation amount, or an acceleration of change of the accelerator manipulation amount, is greater than or equal to a predetermined value, when a vehicle acceleration is greater than or equal to the target acceleration, execute a drive force limiting process, to limit the drive force generated by the drive source to a value lower than a value that corresponds to the acceleration manipulation amount and during execution of the drive force limiting process, reduce the degree of limiting of drive force as the gradient of a road surface of an uphill increases.

2. The drive force control device for a vehicle according to claim 1, wherein the electronic control unit is configured to:

set the target acceleration such that the target acceleration is decreased as the vehicle speed increases, and during the execution of the drive force limiting process, adjust the drive force based on the target acceleration.

3. The drive force control device for a vehicle according to claim 1, wherein the electronic control is configured to:

determine a feedback drive force through feedback control based on the difference between the target acceleration of the vehicle, and the actual acceleration of the vehicle, determine a feed-forward drive force through feed-forward control based on the gradient, and calculate a target drive force during the execution of the drive force limiting control based on the feedback drive force and the feed-forward drive force.

4. The drive force control device for a vehicle according to claim 1, wherein the device includes an acceleration sensor for detecting the vehicle acceleration and a speed sensor for detecting the vehicle speed, and the electronic control unit is configured to use, as a substitute for the gradient, a value obtained by subtracting a differential value of the vehicle speed detected by the speed sensor from a detection value of the acceleration sensor.

* * * * *